US005832981A

United States Patent [19]

McDonald et al.

[11] Patent Number: 5,832,981

[45] Date of Patent: Nov. 10, 1998

[54] CONSTRUCTION AND METHOD OF MAKING HEAT-EXCHANGING CAST METAL FORMING TOOL

[75] Inventors: Robert R. McDonald, Traverse City; William O. Jones, Midland, both of Mich.

[73] Assignee: Metallamics, Inc., Traverse City, Mich.

[21] Appl. No.: 820,806

[22] Filed: Mar. 19, 1997

[51] Int. Cl.[6] ..... B22C 7/02; B22D 19/04; B22D 29/00; B22D 27/04

[52] U.S. Cl. ..... 164/36; 164/98; 164/131; 164/306; 164/348

[58] Field of Search ..... 164/98, 34, 35, 164/36, 131, 348, 306, 312

[56] References Cited

U.S. PATENT DOCUMENTS 4,285,385 8/1981 Hayashi et al. ..... 164/34

FOREIGN PATENT DOCUMENTS

WO 96/17716 6/1996 WIPO .

OTHER PUBLICATIONS

Fansteel/Wellman Dynamics, Premium Quality Sand Castings brochure (1997).

"High Performance Castings, A Technical Guide", Elihu F. Bradley, ASM International, Chapter 5, pp. 95–122 (1989).

*Primary Examiner*—Kuang Y. Lin

*Attorney, Agent, or Firm*—Reising, Ethington, Learman & McCulloch,PLLC

[57] ABSTRACT

A one-piece cast metal heat-exchanging forming tool is prepared using an expendable porous preform that is cast in place within a cast metal forming tool. The expendable preform is thereafter extracted to leave behind a network of inter-connected pores and passages within the body of the tool through which a heat transferring fluid may be circulated to transfer heat to or from a substantially non-porous contoured shaping surface of the tool. Fluid distribution/collection lines and vacuum lines may be incorporated in the tool during casting.

30 Claims, 4 Drawing Sheets

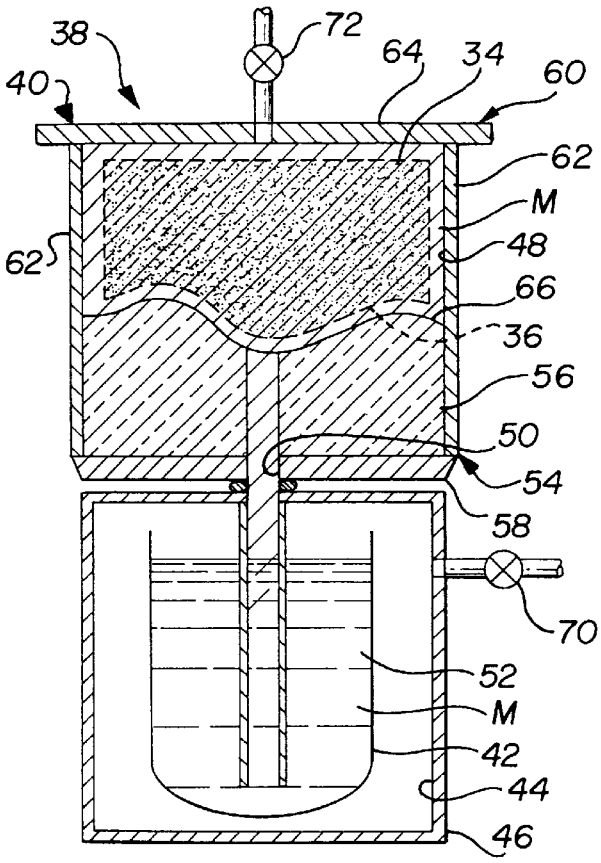
FIG - 3
FIG - 4
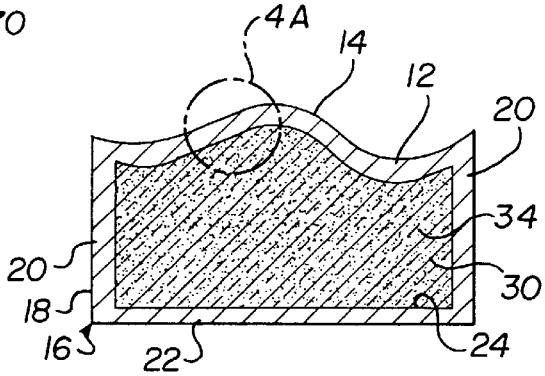
FIG-4A
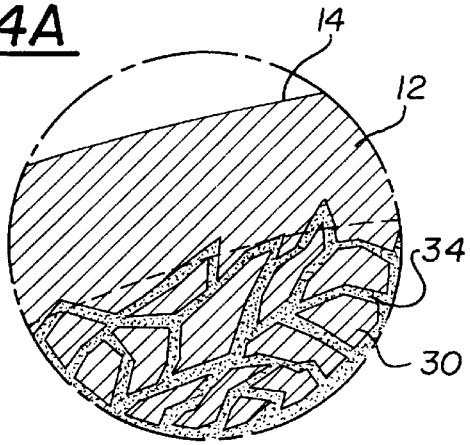
FIG-5
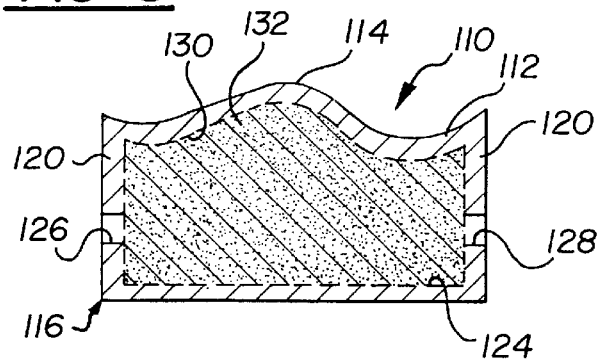

FIG-6
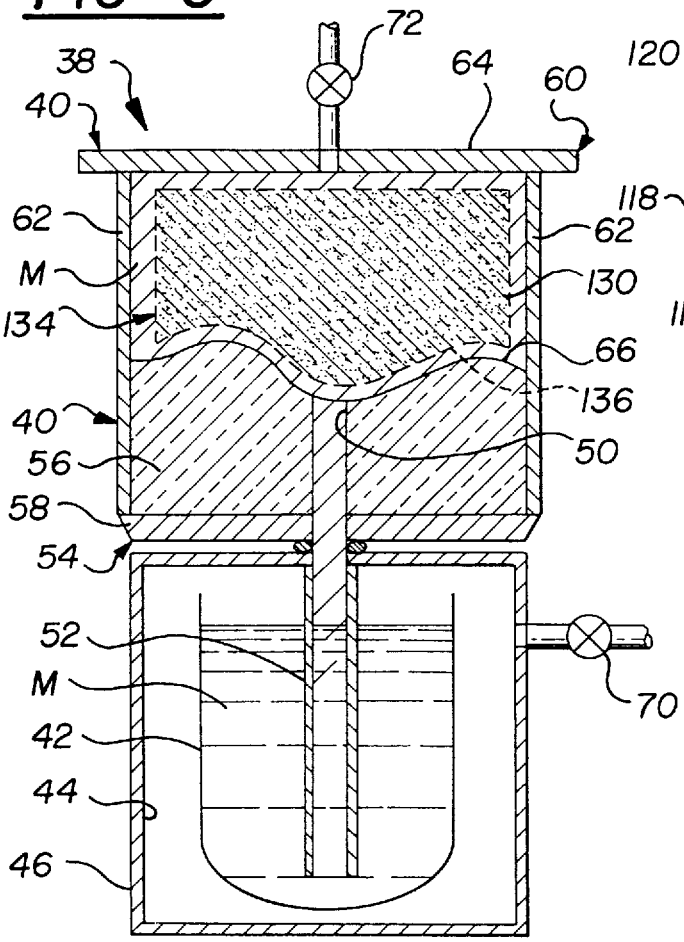
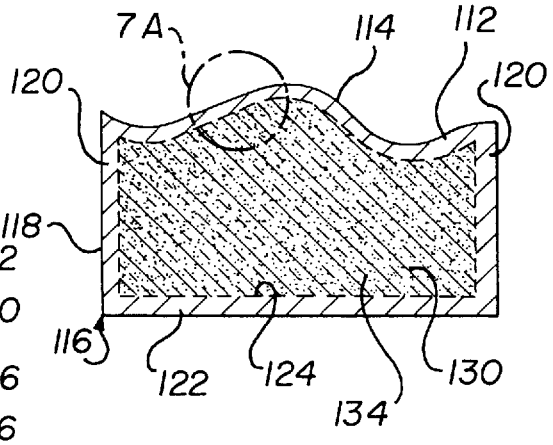
FIG-7
FIG-7A
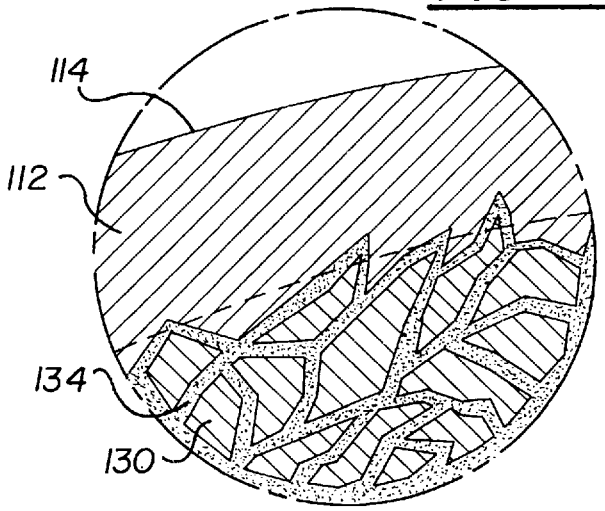

CONSTRUCTION AND METHOD OF MAKING HEAT-EXCHANGING CAST METAL FORMING TOOL

TECHNICAL FIELD

This invention relates to the construction and manufacture of shape-imparting forming tools such as molds and dies having heat-exchanging characteristics.

BACKGROUND OF THE INVENTION

Forming tools, such as metal molds and dies are employed in many processes to impart a desired shape to an article of manufacture. For example, metal molds and dies are used to produce cast articles, of metal, plastics, glass, rubber, etc., having the shape of the casting cavity of the tool. Metal dies are also used in other forming operations such as stamping, pressing, coining, drawing, extruding, forging, etc., to impart a desired shape to a metal sheet or billet. In the plastics and glass making industry, metal dies are used to mold or shape various plastics, resins, composites, and glass to produce various shaped articles from these materials.

In many of these forming operations, a considerable amount of heat is present due to preheating the material to be formed and must be extracted before the completed article can be removed from the forming tool. In molding hot flowable plastics material, for example, the resin must be heated prior to shaping and then after the resin is formed the shaped article must be sufficiently cooled before removal from the die in order to render the material form stable. It is of course desirable in all of these operations that the forming operation be carried out as quickly as possible in order to maximize the productivity of personnel and processing equipment. A major factor governing the quality and cycle time is the rate and uniformity of heat extraction from the article.

According to the present practice of manufacturing forming tools, it is quite common when making a metal forming tool to begin with a solid block of metal into which a shaping surface is machined having a contour corresponding to that of the shape of the article to be formed by the tool. It is also common to bore fluid passages into the block beneath the shaping surface through which a heat transferring fluid may be circulated to draw heat from or conduct heat to the mold tool and hence the article being formed. Drilling such fluid passages, however, has its limitations since shaping surfaces are often of a complex contour making it difficult if not impossible to uniformally extend the passages into all areas of the tool where they are required to achieve the desired cooling or heating characteristics of the forming tool and to achieve optimum heat transfer efficiency.

Published International Application No. WO-96/17716, now U.S. Pat. No. 5,609,922, issued Mar. 11, 1997 which is commonly assigned to the assignee of the present invention, discloses a forming tool designed to transfer heat more efficiently and uniformally than the traditional manner described above. Described is a manufacturing process for making a heat exchanging forming tool in which a porous heat transferring body, such as a block of foamed metal, is machined in much the same manner as that of the solid blocks described above to provide a contoured surface corresponding to the desired configuration of the shaping surface to be made. Once formed, a metal layer is thermally sprayed onto the contoured surface to develop a non-porous shaping surface. The open metal network of the porous body draws heat from the shaping surface and the network of open pores defines a tortuous flow path for a heat transfer fluid to pass to provide rapid, uniform cooling or heating of the shaping surface and thus the article being formed by the tool.

Although the porous body forming tool described in the previous paragraph is considered to be a tremendous advancement over traditional solid block forming tools, machining the shaping surface into the porous metal body is a costly, time-consuming process. Thermal spraying is also costly and requires specialized equipment and skilled operators.

A principal object of the present invention is to improve on these early developments in heat-exchanging forming tools by simplifying the construction and method of making high efficient heat-exchanging forming tools.

SUMMARY OF THE INVENTION AND ADVANTAGES

In a broad sense, the invention provides a method of casting a forming tool in a way that produces a one-piece monolithic structure having a non-porous shaping portion backed by a porous heat-exchanging support body that would be difficult if not impossible to produce by conventional machining practices. The porous body forms an extended heat transfer surface of the shaping portion and provides a tortuous flow path through the body that generates turbulent flow of a heat transfer fluid at low fluid flow rates. The porous body further provides the tool with the structural integrity required to withstand compressive molding forces and hydrokinetic tensile forces exerted by the fluid flowing through the tool during operation.

According to one aspect of the invention, a porous insert is prepared from an open network of expendable material, such as ceramics or salts, patterned after a corresponding network of open interconnected pores and passages. The insert is suspended within a cavity of a casting mold such that a first surface of the insert is spaced above an opposing contoured surface of the cavity having a shape corresponding inversely to the shaping surface to be made. Molten metal is cast into the cavity and surrounds the insert and infiltrates the network of pores and passages resulting in a monolithic structure having a non-porous shaping surface portion formed between the insert and contoured cavity surface and a porous metal network portion occupying the pores of the insert. The original porous insert is extracted from the tool following casting leaving behind a corresponding network of interconnected pores and passages throughout the metal network in communication with one another and the non-porous shaping surface providing a tortuous flow path through the support body for efficient, uniform cooling or heating of the shaping surface. Casting the tool enables all exterior surfaces to be as-formed to near net shape.

The invention has several advantages over conventional forming tools described above and the early heat-exchanging forming tools disclosed in the aforementioned published application. Rather than machining the forming tool from a block of metal, the tool of the present invention is formed from the inside out beginning with an extractable insert around which the forming tool and its shaping surface is cast to shape. This greatly simplifies the manufacturing process and provides a rugged, near net shape construction in which the non-porous shaping surface, the remaining exterior mold surfaces, and the porous support body are formed as one whole piece.

The casting of the forming tool further simplifies the manufacturing process by eliminating the extensive machining and thermal spraying of the early heat-exchanging forming tools mentioned above, thus reducing the time and cost involved in manufacturing forming tools.

The direct metallurgical and mechanical heat flow path provided by the one-piece construction improves the heat transfer characteristics of the forming tool thereby increasing its efficiency and reducing the amount of energy required in the heat transfer circuit to heat and/or cool the article being shaped by the tool.

According to another aspect of the invention, the extractable insert may be pre-infiltrated with metal. During casting, the metal of the insert bonds mechanically and metallurgically with the molten cast metal, resulting in a similar one-piece monolithic structure like the one-piece cast structure described above. Following casting, the extractable material is withdrawn as before leaving behind an internal network of interconnected pores and passages through which heat transfer fluid may be passed.

THE DRAWINGS

Presently preferred embodiments of the invention are disclosed in the following description and in the accompanying drawings, wherein:

FIG. 3 is a view like FIG. 2 but showing molten metal cast into the mold and about the insert;

FIG. 4 is a cross-sectional schematic view of the resultant cast forming tool blank prior to extracting the insert;

FIG. 4A is an enlarged schematic sectional view of the encircled region 4A of FIG. 4;

FIG. 5 is a cross-sectional view of a forming tool constructed in accordance with a second embodiment of the invention;

FIG. 6 is a schematic cross-sectional view of an insert prepared according to the second embodiment of the invention shown supported in the mold;

FIG. 7 is a cross-sectional schematic view of the resultant cast forming tool of the second embodiment prior to withdrawing the extractable insert material;

FIG. 7A is an enlarged schematic sectional view of the encircled region 7A of FIG. 7;

DETAILED DESCRIPTION

The invention is broadly related to forming tools used for shaping any of a variety of shapable materials such as, for example, metal, plastics, thermoplastics, thermosets, elastomers, rubbers, foams, resins, glass, composites, etc., according to any of a variety of manufacturing processes. Such processes include, for example metal casting, stamping, extruding, forging, drawing, rolling; plastic fabrication processes including injection molding, blow molding, compressing molding, foam molding, reaction injection molding, thermoforming, thermoform/thermoset molding, rotational molding; and in the glass making industry, molding or shaping glass; and other applications where a tool is employed to impart a shape to a shapable material in the manufacture of an article including those tools and processes disclosed in the aforementioned International Published Application No. WO-96/17716 now U.S. Pat. No. 5,609,922 issued Mar. 11, 1997, the disclosure of which is incorporated herein by reference.

The invention is concerned more specifically with the manufacture of heat-exchanging forming tools employing a casting process built around an expendable porous insert that results in an all-in-one cast and shaped forming tool that is rugged, cost effective and has desirable heat-exchanging characteristics.

Figure 1:
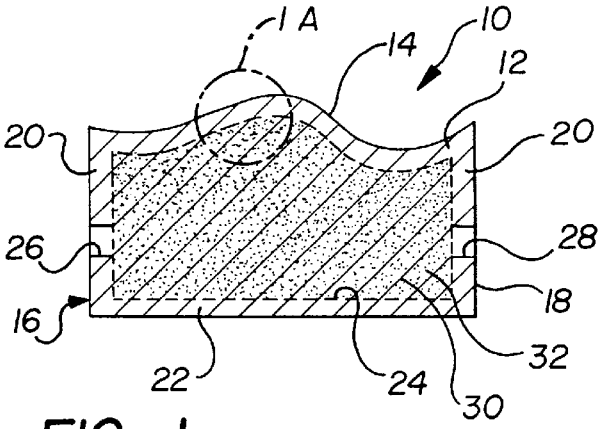
FIG. 1 is a schematic cross-sectional schematic view of a forming tool constructed in accordance with a first embodiment of the invention.

Such a forming tool constructed in accordance with a first embodiment of the invention is illustrated schematically in FIG. 1 and designated generally by the reference numeral 10. The tool 10 is of a one-piece monolithic cast metal structure having a non-porous shaping surface portion 12 in the form of a generally uniform thickness skin or shell presenting an outer contoured shaping surface of predetermined configuration corresponding to that of the article to be shaped by the tool 10.

The shaping surface portion 12 is backed by a porous heat-exchanging support body 16. The body 16 includes a non-porous outer shell portion 18 that is as-cast to near net or final shape and has four upstanding shaped side walls 20 integrated at their upper ends to the shaping surface portion 12 and at their opposite lower ends to a shaped bottom wall 22 of the shell 18 defining an internal chamber 24 within the cast structure. At least one and preferably at least a pair of access openings 26, 28 are provided in the shell 18 for circulating a heat-transferring fluids through the chamber 24 in order to transfer heat to or from the shaping surface portion 12 during operation of the tool. Suitable heat transfer fluids include liquids such as hot or cold water and gases such as steam or steam under vacuum to achieve heat transfer temperatures from room temperature to about 350°.

Figure 1A:
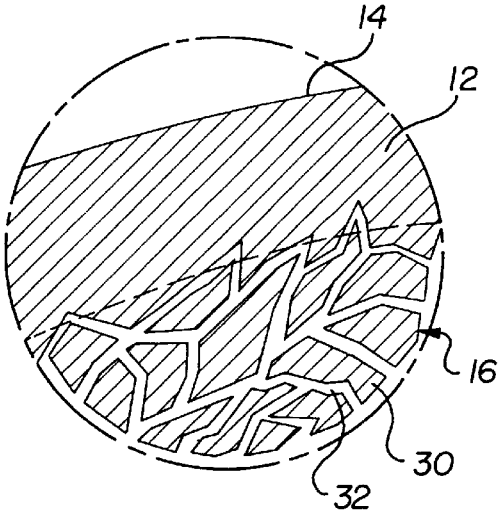
FIG. 1A is an enlarged schematic sectional view of the encircled region 1A of FIG. 1.

Within the chamber 24 is a heat-conducting porous metal network structure 30 which, in the first embodiment, is as-cast as an integral, monolithic portion of the casting from the same cast metal material as that of the rest of the casting. In other words, all portions of the forming tool, including the shaping surface 12, shell 18, and porous metal network 30 are as-cast from the same materials as a single, whole unit. As such, there is a continuous metallurgical and mechanical transition from one portion of the casting to the next, and particularly between the shaping surface 12 and the metal network structure 30, as illustrated schematically in FIGS. 1 and 1A uninterrupted by any transitional interfaces or changes in material providing a direct, uninterrupted flow path for conducting heat between the shaping surface portion 12 and the porous support body 16 of the casting 10.

The metal network 30 is open and porous and as such provides a corresponding network of open interconnected pores and passages 32 throughout the metal network 30. The open porous structure of the network 30 functions as an extended heat transfer surface of the shaping portion 12 by exposing a large surface area of the metal casting material to the heat transferring fluid as it passes through the network of pores 32 of the chamber 24 to quickly and efficiently transfer heat between the tool 10 and fluid. The metal network 30 also functions to provide needed structural support and integrity to the tool 10 to withstand compressive external molding forces that the tool may be subjected to during a forming operation, as well as internal hydrokinetic tensile forces that may be exerted by the heat transfer fluid as it flows under pressure through the body 16.

The network of pores 32 defines a tortuous flow path for the heat transfer fluid causing it to flow turbulently through the body 16 at low flow rates, further enhancing the rate at which heat can be transferred to or from the shaping surface portion 12 and thus the material being shaped. In addition to the high rate of heat transfer, the metal and porous networks 30, 32 can be formed in various patterns, sizes, shapes, and relative distributions to control the rate of heat transfer across the shaping surface 12. In many cases, it is desirable that all regions of the shaping surface 12 be heated or cooled uniformly, whereas at other times it may be desirable to heat or cool one region more than others. In each case, the metal network structure 30 may be engineered to have whatever porosity and distribution needed to achieve the desired heat transfer characteristics.

Various metal materials or alloys thereof may be used to fabricate the forming tool 10. The materials include, but are not limited to, aluminum, zinc, tin, magnesium, copper, iron, nickel, steel, titanium, cobalt and alloys thereof and intermetallic alloys such as nickel-aluminide, to name a few. The selection of the metal material for the forming tool 10 will depend in large part on the particular end used of the forming tool 10 and the term "metal material" is intended to embrace all metallics including pure metals and alloys thereof as well as composites and intermetallics.

Figure 2:
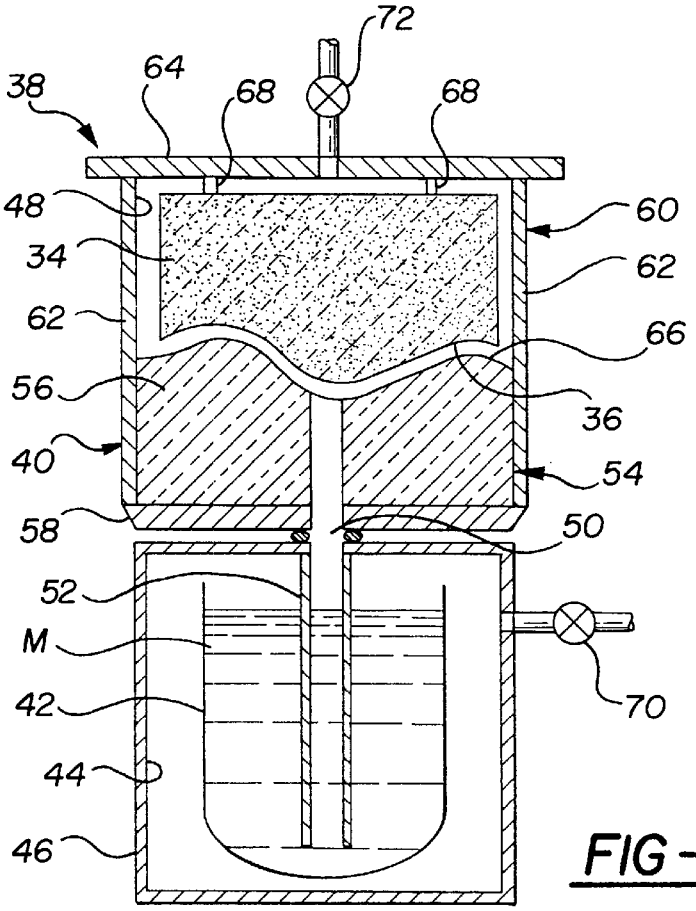
FIG. 2 is a schematic cross-sectional elevation view of an extractable insert shown supported within a cavity of a casting mold.

FIGS. 2–4 illustrate a preferred casting method in accordance with the first embodiment of the invention for casting the forming tool 10 of FIG. 1. The process begins with the provision of an expendable preform insert or pattern 34 which, as illustrated in FIG. 2, may be configured to the general shape and contour of the forming tool 10 but smaller in size by an amount equal to the thickness of the non-porous shaping surface portion 12 and outer shell portion 18. Included among the contours is a first surface 36 of the insert 34 corresponding substantially in configuration to that of the predetermined shaping surface portion 14 of the forming tool 10 to be made.

The expendable insert 34 is a temporary structure that is patterned to conform in size and shape to that of the porous network of pores and passages 32 to be formed in the tool 10. When the insert 34 is cast-in-place within the forming tool 10, it preserves a space within the casting devoid of the cast metal material such that upon its removal the corresponding network of the open interconnected pores and passages 32 is left behind.

The material selected for the insert 34 is one that is sufficiently strong, thermodynamically stable, chemically resistant and heat-resistant to withstand having molten metal cast about it while retaining its expendability that enables it to be withdrawn from the forming tool following casting to provide the network of pores 32.

Candidate materials for the insert 34 include ceramics and soluble salt materials of the type conventionally used as core materials in metal casting applications. Inorganic salts and particularly carbonate salts may be utilized as the expendable insert material. Included among the suitable carbonate salt compositions are those listed in Table 1 below:

TABLE 1

| Carbonate Salts | | |
|---|---|---|
| Salt | Melting Point (°C.) | Decomposition Temp (°C.) |
| $Li_2CO_3$ | 723 | 1310 |
| $Na_2CO_3$ | 851 | |
| $K_2CO_3$ | 891 | |
| $CaCO_3$ | 1339 | 899 |
| $BaCO_3$ | 1740 | 1450 |

The family of carbonate salts listed in Table 1 may be readily formed or cast into various shapes including shaped, open cell, porous structures in the interstices of which metal may be cast. The candidate casting metals for use with these salts include aluminum, magnesium, zinc, tin, copper, iron, nickel, some intermetallics such as $Ni_3Al$, cobalt, gold, silver, and alloys thereof. Following casting, such salts may be removed or extracted by the action of a mild acidic solution such as HCl, $HNO_3$, acetic acid, $H_2SO_4$, etc. Upon contact with the acid solution, a vigorous reaction takes place in which $CO_2$ is released and salt water is formed, whereby the carbonate salt is promptly and readily "lost" and with minimal environmental impact ($CO_2$ gas and salt water being the byproducts of the reaction).

Of course, other materials which meet the criteria of being durable enough to withstand the casting environment yet able to be extracted following casting would also be suitable insert materials 34.

The insert 34 comprises an open porous network of the expendable material defining a corresponding network of interconnected pores generally uniformly distributed throughout the insert. The selected porosity of the insert 34 will depend in part on the desired porosity of the forming tool 10 to be produced, with there being an inverse relationship between the two. For example, providing an insert 34 having 60% porosity by volume will produce a metal network structure 30 that is 40% porous by volume. The preferred porosity range of the tool is on the order of 30–70% volumetric porosity, but the invention contemplates a much wider range of about 5–95% volumetric porosity, depending upon the design criteria and molding requirements of a particular application.

FIG. 3 schematically shows a casting apparatus 38 which may be used for casting the forming tool 10. While the apparatus shown and preferred is a low pressure casting apparatus, the invention fully contemplates that any of various other known casting processes may be used to produce the monolithic cast tool of the invention. The processes include but are not limited to sand casting, die casting, vacuum casting, squeeze casting, injection molding, permanent mold casting and other standard casting techniques.

The preferred low pressure casting apparatus 38 includes a casting mold 40 arranged above a ladle 42 of molten metal M contained within a sealed chamber 44 of a holding vessel 46. The mold 40 is formed with a cavity 48 whose walls correspond in size and shape to the forming tool 10 to be made. A bottom inlet 50 of the mold 40 is coupled to a vertical fill tube 52 whose lower free end is submerged in the molten metal M within the ladle 42.

Low pressure casting involves delivering molten metal into a mold cavity under low pressure from below to slowly fill the mold cavity from the bottom up under precisely regulated low pressure and flow rate conditions (typically in the range of about 5–20 psi) to minimize turbulence and assure complete filling of the mold cavity including thin sections. However, higher pressures of up to 200 psi or more may be employed.

Various mold types are used in low pressure casting applications including sand mold and permanent metal molds. The preferred construction of the mold 40 for use in making the forming tool 10 includes a lower part 54 comprising a shaped, ceramic block 56 mounted on a base plate 58 contoured inversely to that of the shaping surface 14 of the forming tool 10. A separable upper part 60 in the preferred form of an open-bottomed metal box-like structure is also provided having sides 62 closely surrounding the sides of the ceramic block 56 and sealed at their lower ends against the base plate 58. A top wall 64 of upper part 60 is secured to the upper ends of the sides 62 above an upper surface 66 of the block 56. All mold surfaces are contoured inversely to that of the desired shape of the exterior of the tool 10.

As illustrated in FIG. 2, the insert 34 is inverted within the cavity 48 of the mold 40 with its shaped surface 36 suspended above the surface 66 of the block 56 to provide a gap therebetween corresponding in shape and dimension to the shaping surface portion 12 of the forming tool 10 to be made. The remaining sides of the insert 34 are likewise spaced from the adjacent sides 62 and top wall 64 of the mold 40 by a distance corresponding to the non-porous shell portion 18 of the forming tool 10. Support for the insert 34 may be provided by means of releasable connectors or mounts 68 fixed to the insert 34 and mounted releasably to the upper part 60 of the mold 40. The connectors 68 may be constructed of metal or other material that becomes a permanent integrated cast-in-place part of the forming tool 10 or may be fabricated of an extractable material such as that used for the insert 34, which would result in openings being cast in the shell 18 that could serve the purpose of the openings 26, 28 described above.

Once the insert 34 is positioned properly within the mold 40, the molten casting metal M is low pressure cast into the cavity 48 via the fill tube or quill 52 and bottom inlet 50 to fill the cavity 48 from the bottom up, as illustrated schematically in FIG. 3. In accordance with conventional low pressure casting practice, computer process control of the differential pressure may be employed to control the flow of the metal into the cavity 48. One way of achieving the differential pressure is to admit compressed air into the chamber 44 thereby displacing the molten metal M in the ladle causing it to travel up the fill tube 52 and into the cavity 48. In addition to or in lieu of pressurizing the chamber 44, the cavity 48 may be evacuated to draw the metal from the ladle 42 into the cavity 48. Suitable valves 70, 72 may be fitted to the vessel 46 and mold part 60 to control the relative pressure between the chamber 44 and cavity 48. Low pressure filling of the cavity 48 is preferred over other casting techniques such as gravity casting since it enables the molten metal M to fully penetrate and fill the pores of the insert 34 and form a sound, pore-free casting about the insert 34.

The molten metal M is allowed to cool and solidify, after which the resultant cast forming tool blank is removed from the mold 40. It will be seen from FIGS. 4 and 4A that the insert 34 is encapsulated by the non-porous shaping surface portion 12 and shell portion 18 and its porous network completely filled with cast metal. The insert 34 is extracted from the casting through the openings 26, 28. These openings may either be cast in place as mentioned or else bored through the shell 18 in a post-casting operation. Where the insert 34 is constructed of ceramic material, it may be chemically leached from the casting using a suitable acid of the types well known in the art for extracting such materials from metal castings. Where the insert 34 is made of salt, the acid leaching techniques described above may be utilized to extract the material through the openings 26, 28.

FIG. 5 illustrates a forming tool constructed in accordance with a second embodiment of a invention, wherein like reference numerals are used to indicate like features with respect to the forming tool 10 of FIGS. 1–4A of the first embodiment, but are offset by 100. The tool 110 is the same except that the porous metal network 130 is prefabricated prior to casting and united mechanically and metallurgically with the shaping surface portion 112 and shell portion 118 of the tool 110 during casting.

FIGS. 6 and 7 illustrates the manner in which the forming tool 110 of the second embodiment is made. As shown in FIG. 6, the process begins with an insert 134 like that of the first embodiment 34 except that the interconnected pores and passages of the insert 134 are infiltrated with metal to provide what ultimately becomes the porous metal network 130 in the final tool 110. The metal occupying the pores of the insert 134 is selected to be identical to or metallurgically compatible with the casting metal of the forming tool 110 such that the two are mechanically and metallurgically united during casting to provide a one-piece monolithic structure.

The metal infiltrated insert 134 is suspended within the mold cavity 48 in the same manner as described above for the insert 34. Molten metal M is then cast under low pressure into the cavity 48 and surrounds the insert 134, filling the space between the insert 134 and the walls of the cavity 48. The outer surface regions of the insert metal are exposed and suitably treated to remove any oxides, contaminants, or other impurities that would inhibit the insert metal from bonding metallurgically with the molten casting metal M, as illustrated schematically in FIG. 7A.

Following casting, the extractable portion of the insert 134 is withdrawn from the forming tool 110 in the same manner to leave behind the internal network of interconnected pores 132 within the tool 110 like that of the tool of FIG. 1.

The extractable porous insert 34 of the first embodiment may be made in any of a number of ways including lost foam or lost wax processes, which are well known to those skilled in the art. The infiltration of the metal 130 into the insert 134 may be carried out by a similar low pressure casting process described above except using a mold cavity that is the same size and shape as the insert 134.

Figure 8:
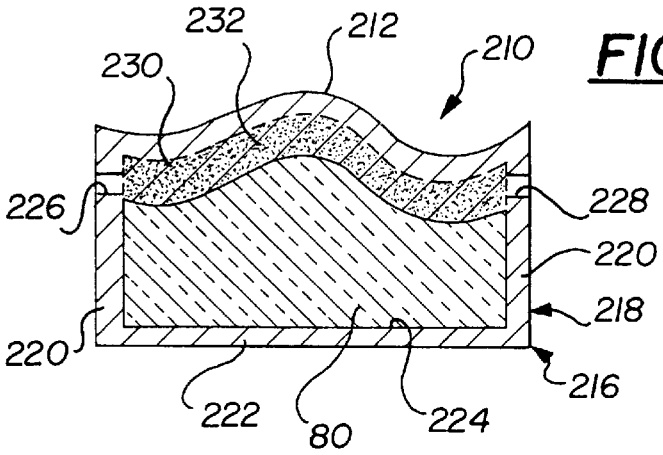
FIG. 8 is a cross-sectional schematic view of an alternative forming tool construction.

FIG. 8 illustrates another embodiment of the invention, wherein like reference numbers are used to indicate like features with respect to the forming tool 10 of FIGS. 1–4*a* of the first embodiment, but are offset by 200. The tool 210 is the same except that the porous metal network 230 occupies only a portion of the chamber 224 directly beneath the shaping portion 212 and in communication with the inlet and outlet openings 226, 228. The remainder of the chamber 224 is occupied by a cast in place insulated support structure 80 which may a ceramic block or the like. The FIG. 8 tool 210 thus provides a porous envelope behind the forming surface 212, but with a limited volume. The porous region has a thickness, for example, of about an inch—much less than the overall thickness of the tool 210. Such a structure provides advantageous heating and cooling characteristics described above with respect to the other tool configuration, but with less of the mold tool dedicated to the porous metal structure 230. By taking up the remainder of the space in the chamber 224 with the insulated support structure 80, the overall weight of the tool 210 is substantially less than it would be if the same space were occupied by a solid mass of the cast metal.

Figure 9:
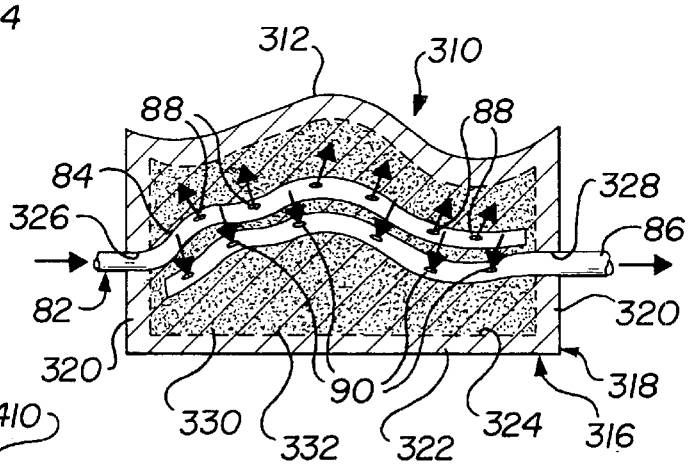
FIG. 9 is a cross-sectional schematic view of a forming tool having a built-in flow control system.

FIG. 9 illustrates still a further embodiment of the invention in which a monolithic forming tool 310 like any of the preceding constructions is fitted with a distribution an collection system 82 to control the flow of the heat transfer fluid through the metal network structure 330 of the tool. As illustrated, the system 82 may comprise one or more or a series of branched inlet and outlet flow tubes 84, 86 that extend throughout the metal porous structure 330. Holes 88 are provided at strategic locations along the tubes to distribute and collect a transfer fluid in a designed pattern to achieve the desired heat transfer properties across the shaping surface portion 312. In practice, heat transfer fluid introduced to the inlet flow tube 84 would exit through holes 88, circulate through the porous metal network structure 330 in a prescribed region, and then be drawn by low pressure into the outlet tube 86 through associated hole or holes 90 therein.

Such a distribution and collection system 82 can be designed to achieve for example, uniform pressure drop and thus even flow of the heat transfer fluid throughout the porous metal structure 330. The tubes 84, 86 may be embedded in situ within the porous insert 334 and thereafter cast in place in the metallic tool 310. The holes 88, 90 in such case would be covered by the insert material 334 to prevent molten metal from entering the tubes 84, 86 during casting, thereby allowing them to be open and in communication with the network of passages and pores 332 when the insert 334 is extracted. It will be appreciated that the insert 334 may be extracted through the tubes 84, 86 using the techniques described above.

Figure 10:
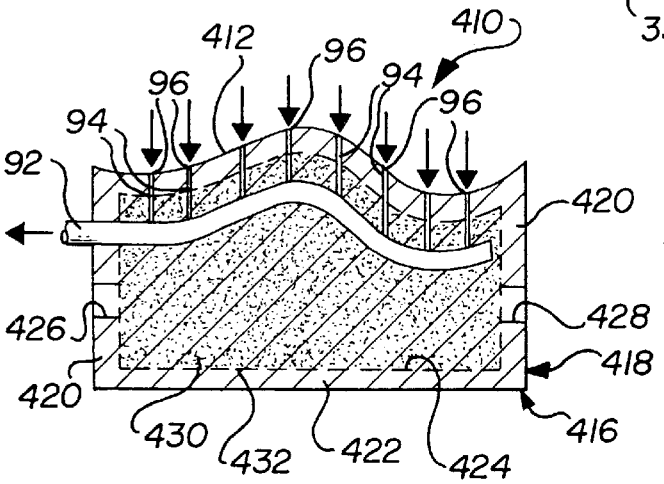
FIG. 10 is a cross-sectional schematic view of a forming tool having a built-in vacuum system.

FIG. 10 illustrates yet another embodiment of the invention in which the tool 410 illustrated is like the other embodiments described above except that in includes the provision of a built-in vacuum suction system having lines 92 which are cast in place in the same manner as the flow tubes 84, 86 described above expect that the lines 92 communicate by branched lines 94 with the shaping surface 412. As such, the shaping surface 412 will be formed with a plurality of minute openings 96 across its surface in communication with the lines 92 for purposes of drawing a vacuum across the shaping surface 412 of the tool 410. The openings 96 may be drilled into the surface 412 to connect with the branch lines 94 in a post casting operation or, may be cast in place by means of suitable cores or pull-back pins communicating with the branch lines 94 or by locating the openings of the branch lines 94 at the shaping surface 412 during casting. But for the vacuum openings 96, the shaping surface 412 remains substantially non-porous and as such the tool 410 retains the desired heat transfer characteristics of the mold tools described previously.

The tool 410 may be used, for example, to vacuum form a plastic sheet wherein the heat transfer fluid may be employed to heat the sheet to its forming temperature and the built-in vacuum system 92 employed to draw the hot sheet into conformity against the shaping surface 412.

Figure 11:
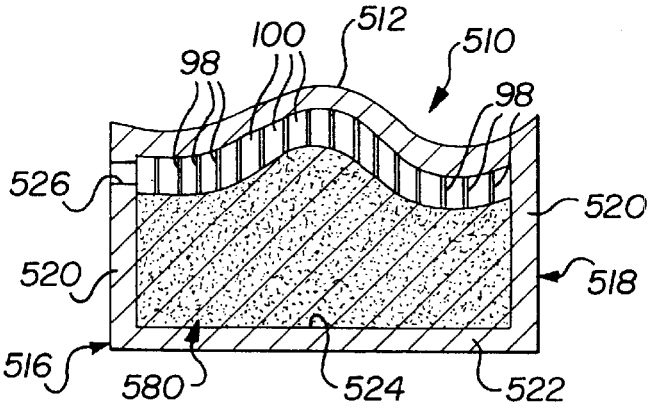
FIG. 11 is a cross-sectional schematic view of a forming tool constructed according to another embodiment of the invention.

The invention further contemplates specific mold designs which are made to accommodate high molding pressures and/or high molding temperatures. For example, FIG. 11 illustrates a mold construction for injection molding and other higher pressure molding conditions (such as for the molding of glass filled compounds in powder or sheet form), where the forming pressures on the mold face may range between 500 psi and 5000 psi and even upwards of 15,000 psi. Further, under these conditions of higher molding pressures, forming temperatures may range upwards to 300° F. and even upwards of 1000° F. As before, the same reference numerals are used to represent like parts, but are offset by 500. The mold 510 of FIG. 11 is like that of FIG. 8 except that the porous media is in the form of metallic posts or pillars 98 which are placed throughout the porous cavity or chamber 524 and connect the non-porous molding face 512 with an inert body 580 which may be in the nature of the support structure 80 of FIG. 8. In this way, the posts 98 serve the same purpose and function as the porous metal network structure 30 above, with openings 100 between the posts 98 serving to provide a tortuous flow path for heat transfer fluid. The density and position of these pillars or posts is a matter of structural calculation as to the pressures and temperatures involved.

In further special specific molding requirements, heating of the mold and the molding surface can take place using steam and/or other heat transfer fluid systems where condensation of the vapor to liquid occurs within the porous cavity, thus providing for heating and/or cooling of the molding surface. Under these instances, the tortuous path requirements within the porous media are eased in the condensation or vaporization of heat transfer fluid and thus the heat transfer affected with occur evenly throughout the porous cavity thus providing an isothermal molding surface in keeping with the principles of the invention.

The disclosed embodiments are representative of presently preferred forms of the invention, and are intended to be illustrative rather than definitive thereof. The invention is defined in the claims.

I claim:

1. A method of making a heat-exchanging forming tool having a substantially non-porous shaping surface of predetermined contour and a porous heat-exchanging support body, said method comprising the steps of:

providing an insert having a porous network of expendable material and a first surface;

supporting the insert within a cavity of a casting mold with the first surface of the insert spaced from an opposing surface of the cavity inversely contoured in relation to that of the shaping surface of the forming tool to be made;

casting molten metal into the cavity and about the insert and permitting the metal to solidify; and removing the network of expendable material from within the cast forming tool to provide a corresponding network of interconnected open pores within the support body of the tool adjacent a non-porous shaping surface portion formed by the metal cast in the space between the first surface of the insert and the opposing surface of the cavity.

2. The method of claim 1 wherein the insert is encapsulated by the molten metal forming a non-porous shell substantially around the insert.

3. The method of claim 2 including forming at least one access opening in the shell to access the insert.

4. The method of claim 3 wherein the expendable material of the insert is withdrawn through the opening in the shell.

5. The method of claim 4 wherein the expendable material is ceramic and is leached from within the cast forming tool.

6. The method of claim 4 wherein the expendable material is a salt and is withdrawn by reacting the salt with an acid solution to produce $CO_2$ gas and salt water which escapes from casting through the opening.

7. The method of claim 1 wherein the insert includes a network of metal occupying the pores of the insert.

8. The method of claim 7 wherein the molten casting metal bonds with the metal of the insert during casting.

9. The method of claim 8 wherein the metal material of the insert is the same as that of the casting metal.

10. The method of claim 9 wherein the insert is encapsulated by the casting metal forming a non-porous shell about the insert when the casting metal solidifies.

11. The method of claim 9 including forming at least one access opening through the shell to provide external access to the insert and to the network of internal pores within the cast member upon removal of the expendable material of the insert.

12. The method of claim 11 wherein the expendable material of the insert is withdrawn through the opening in the shell.

13. The method of claim 7 wherein the expendable material is ceramic and is leached from within the cast forming tool.

14. The method of claim 7 wherein the expendable material is a salt and is withdrawn by reacting the salt with an acid solution to produce $CO_2$ gas and salt water which escapes from casting through the opening.

15. The method of claim 1 wherein the molten casting metal infiltrates the pores of the insert and upon solidification provides a corresponding network of the casting metal united as a monolithic structure with the non-porous shaping surface of the casting.

16. The method of claim 1 wherein the insert is spaced on all sides from the walls of the cavity forming a non-porous shell around the insert that is formed at least to near net shape upon solidification of the casting metal.

17. The method of claim 16 wherein at least one access opening is formed through the shell.

18. The method of claim 17 wherein the expendable material of the insert is withdrawn through the opening in the shell.

19. The method of claim 18 wherein the expandable material is ceramic and is leached from within the cast forming tool.

20. The method of claim 18 wherein the expendable material is a salt and is withdrawn by reacting the salt with an acid solution to produce $CO_2$ gas and salt water which escapes from casting through the opening.

21. The method of claim 1 wherein the molten metal is low pressure cast into the cavity from below through a bottom inlet in the mold.

22. The method of claim 1 including casting in place together with the porous insert a support structure of insulating material.

23. The method of claim 1 including casting in place a fluid flow distribution and collection system within the porous support body.

24. The method of claim 23 wherein the fluid flow distribution and collection system comprises fluid inlet and fluid outlet tubes embedded in the porous insert structure each formed with holes shielded by the expendable insert material, said tubes being cast in place within the metallic tool wherein the holes are blocked from exposure to the molten metal during casting and thereafter in open flow communication with the porous metal network for directing the flow of heat transfer fluid throughout the porous metal network.

25. The method of claim 1 including casting in place within the porous metal network structure a vacuum suction system and providing a series of openings in the shaping surface in flow communication with the vacuum suction system.

26. The method of claim 25 wherein the vacuum system comprises vacuum lines embedded in the porous insert structure and thereafter cast in place within the metallic tool.

27. The method of claim 26 including forming the openings in the shaping surface during casting.

28. The method of claim 26 including forming the openings in the shaping surface in a post casting operation.

29. A method of making a forming tool having a substantially non-porous shaping surface of predetermined configuration backed by a porous heat exchanging support body, said method comprising the steps of:

forming an insert having a porous network of expendable material infused at least in part with a corresponding network of metal material and having a first surface contoured to correspond to the predetermined configuration of the shaping surface of the tool to be made;

suspending the insert within a cavity of a low pressure casting mold with the first surface of the insert spaced above a lower surface of the cavity contoured inversely to that of the predetermined shaping surface of the forming tool to be made and the remaining sides of the insert spaced from adjacent surfaces of the cavity;

casting molten metal into the cavity under low pressure from below through a bottom inlet in the mold to surround the insert and fill the cavity, and permitting the metal to solidify to produce the substantially non-porous shaping surface portion of the forming tool in the space between the first surface of the insert and the lower surface of the cavity and a non-porous shell portion encapsulating the insert and united to the metal network of the insert;

providing at least one opening through the shell of the cast forming tool to access the insert; and removing the network of expendable material from within the cast forming tool leaving behind an associated network of interconnected internal pores and passages in communication with at least the nonporous shaping surface and through which a heat transferring fluid may be passed to conduct heat to or from the shaping surface portion.

30. A method of making a forming tool having a substantially non-porous shaping surface of predetermined configuration backed by a porous heat exchanging support body, said method comprising the steps of:

forming an insert having a porous network of expendable material defining an associated network of open interconnected pores and passages and having a first surface contoured to correspond to the predetermined configuration of the shaping surface of the forming tool to be made;

suspending the insert within a cavity of a low pressure casting mold with the first surface of the insert spaced above a lower surface of the cavity contoured inversely to that of the predetermined shaping surface of the forming tool to be made;

casting molten metal into the cavity under low pressure from below through a bottom inlet in the mold to surround the insert and fill the open pores of the insert with the molten metal, and permitting the metal to solidify to define a monolithic one piece cast forming tool having the substantially non-porous shaping surface portion in the space between the first surface of the insert and the lower surface of the cavity, a non-porous shell portion encapsulating the insert, and an internal metal network portion occupying the pores of the insert;

providing at least one opening through the shell of the cast forming tool to access the insert; and extracting the expendable insert from within the cast forming tool leaving behind an associated network of interconnected internal pores and passages in communication with the substantially nonporous shaping surface and through which a heat exchanging fluid may be passed to conduct heat to or from the shaping surface.

* * * * *